United States Patent [19]

Weeks

[11] 4,063,878

[45] Dec. 20, 1977

[54] APPLYING SUBLIMATION INDICIA TO PRESSURE-SENSITIVE ADHESIVE TAPE

[75] Inventor: Bruce W. Weeks, Lake Elmo, Minn.

[73] Assignee: Minnesota Mining and Manufacturing Company, St. Paul, Minn.

[21] Appl. No.: 631,183

[22] Filed: Nov. 12, 1975

[51] Int. Cl.[2] ..... D06P 3/00

[52] U.S. Cl. ..... 8/2.5 A; 101/470; 156/241; 427/248 H

[58] Field of Search ..... 101/470; 8/2.5 A; 156/230, 241; 427/248 H

[56] References Cited

U.S. PATENT DOCUMENTS

| | | | |
|---|---|---|---|
| 791,503 | 6/1905 | Roehm | 101/470 |
| 1,895,243 | 1/1933 | Dort | 101/470 |
| 2,598,892 | 6/1952 | Critchlow et al. | 101/426 X |
| 3,121,650 | 2/1964 | Meissner | 156/240 |
| 3,289,573 | 12/1966 | Apicella | 101/27 |
| 3,330,711 | 7/1967 | Marx et al. | 156/234 |
| 3,357,353 | 12/1967 | Teuscher | 101/469 |
| 3,363,556 | 1/1968 | Shely | 101/469 |
| 3,381,789 | 5/1968 | Hawes | 197/45 |
| 3,408,216 | 10/1968 | Mott et al. | 101/470 |
| 3,445,310 | 5/1969 | Danielson et al. | 156/230 |
| 3,454,764 | 7/1969 | Collier et al. | 101/470 |
| 3,508,492 | 4/1970 | Seibert et al. | 101/470 |
| 3,649,332 | 3/1972 | Dybvig | 101/470 |
| 3,952,131 | 4/1976 | Sideman | 101/470 |

FOREIGN PATENT DOCUMENTS

| | | | |
|---|---|---|---|
| 2,062,085 | 6/1971 | France | 101/134.5 |

*Primary Examiner*—Clyde I. Coughenour
*Attorney, Agent, or Firm*—Cruzan Alexander; Donald M. Sell; Gerald F. Chernivec

[57] ABSTRACT

A method for imprinting permanent indicia on backsized pressure-sensitive adhesive tapes comprising contacting the tape with a heat-sublimable dye source material in conjunction with a stencil or raised relief-imaged heat-conductive platen, and raising the temperature to a point sufficient to vaporize the dye, whereupon at least a portion of the dye penetrates through the backsizing to become absorbed in the flexible tape backing. In this manner, the image contained on the tape is permanent, smudge-proof and abrasion-resistant.

3 Claims, 2 Drawing Figures

APPLYING SUBLIMATION INDICIA TO PRESSURE-SENSITIVE ADHESIVE TAPE

BACKGROUND OF THE INVENTION

This invention relates to a process for applying indicia to adhesive tapes. More particularly, the invention relates to a process for applying permanent, non-removable indicia to pressure-sensitive tapes utilizing vapor transfer of a heat-sublimable dye.

Conventional pressure-sensitive tapes typically comprise a substrate or support upon which the pressure-sensitive adhesive is coated. To avoid specific problems, it is common to provide a backsize coating on the opposite side of the support. Such backsize layers may comprise low adhesion release materials, abrasion-resistant materials, solvent barrier-protective backsizing, etc.

In many instances, it is desirable to provide such an adhesive tape with indicia for identification, directional, instructional or merely informative purposes. Such is especially true in the area of carton sealing tapes for cartons which are used to transport merchandise therein by commercial transportation methods. Tapes having indentifying indicia thereon would greatly assist manufacturers, shippers and purchasers. However, such tapes and any indicia thereon must be able to withstand the rigorous treatment normally encountered in the handling and transportation of the carton.

Vaporizable dyes have long been utilized in fabric decorating, wherein patterns or designs are obtained on fabrics, such as textiles, by transfer of volatile dyes from patterns on a transfer sheet to the fabric. Typically, the dye design on a transfer sheet is placed against the fabric and heat and limited pressure are applied. The dyes sublime to vapor form and are transferred from the transfer sheet to the fabric with the dye design intact.

Belgain Pat. No. 807,975 discusses preparation of stencils for use with dye transfer so as to avoid necessity of requiring a transfer sheet having a dye design thereon.

In U.S. Pat. No. 3,860,388 there is disclosed a process for transferring a dye pattern from a transfer sheet to a thermoplastic surface. A polyolefin sheet is interposed between the transfer sheet and the plastic receiving surface which when heated to its softening temperature allows passage of the dye vapors therethrough, and effectively prevents fusing of the dye transfer sheet to the thermoplastic surface at the elevated dye sublimation temperature.

While it would be extremely desirable to imprint backsized pressure-sensitive tapes with smudge-proof permanent indicia, such has heretofore not been available. Common methods for imprinting indicia on tapes do not provide images which are sufficiently durable for such tapes as carton sealing tapes. It has now been found that by utilizing sublimable dyes and dye vapor transfer, imprinted tape having the aforementioned desirable characteristics can be obtained.

SUMMARY OF THE INVENTION

In accordance with the invention, there is provided a method for imprinting permanent, smudge-proof indicia on backsized pressure-sensitive adhesive tape comprising contacting the backsized surface of the tape with a dye source web comprising a dimensionally stable substrate containing a heat-vaporizable dye, placing a heat conductive raised relief-imaged platen on the dye source web surface such that the relief image contacts the dye source web pressing the composite togehter to insure intimate contact and heating the platen to the vaporization temperature of the dye whereupon at least a portion of the dye penetrates the backsize to become absorbed in the tape backing.

In another embodiment, a stencil having dye penetrable image areas and impenetrable background areas can be interposed between the dye source web and the tape instead of utilizing the relief-imaged, heat-conductive platen.

DETAILED DESCRIPTION OF THE INVENTION

The invention can be further illustrated with reference to the accompanying drawings wherein.

Figure 1:
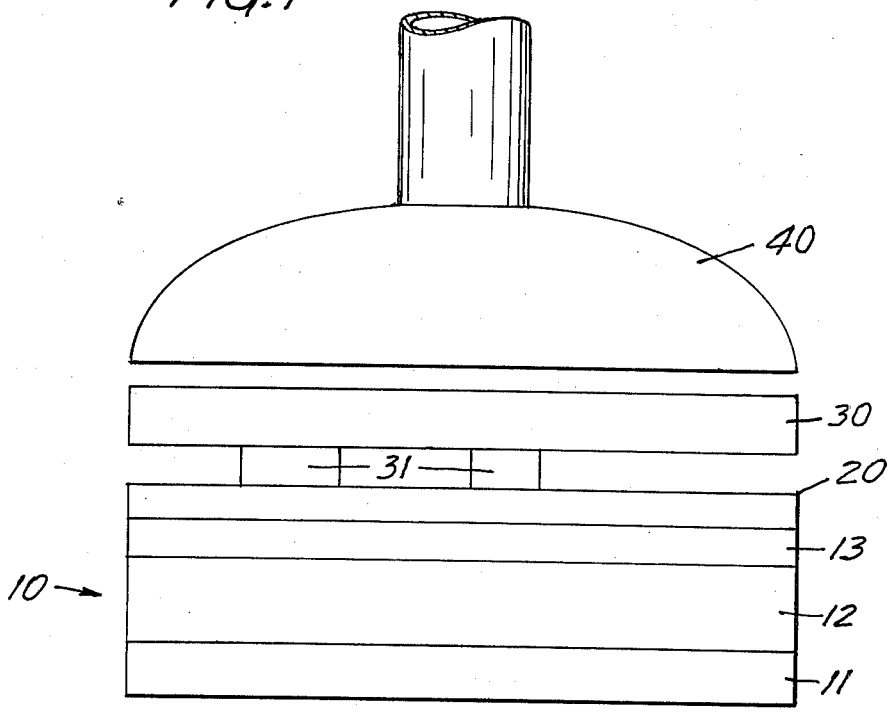
FIG. 1 is a cross-sectional view or end view illustrating the process for the formation of permanent indicia on a pressure-sensitive adhesive tape having a backsizing thereon utilizing heat in conjunction with a sublimable or varporizable dye-coated web.

More specifically, in FIG. 1 there is shown a pressure-sensitive adhesive tape 10 comprising a flexible backing 12 having a pressure-sensitive adhesive 11 on one surface thereof and a backsize layer 13 on the other surface. Placed on the backsized surface 13 of the tape is a dye source material 20 comprising a web or support having a sublimable or vaporizable dye impregnated therein or coated thereon.

Over the dye source material is illustrated an indicia-forming means which in this instance is a heat-conductive platen 30 having relief image surfaces 31 shown thereon. A heat source 40 is provided, typically an infrared lamp or electrical resistance element which must be capable of raising the temperature of the dye source material to the vaporization or sublimation temperature of the dye contained therein.

In operation, the tape 10, dye source web 20 and relief image areas 31 of the heat-conductive platen 30 are brought in intimate relationship under slight pressure to insure intimate contact of the components. The dye source web 20 is contacted by the heat-conductive die 30 only in areas delineated by the relief image 31 thereon and consequently the dye will vaporize or sublime only in such areas.

Figure 2:
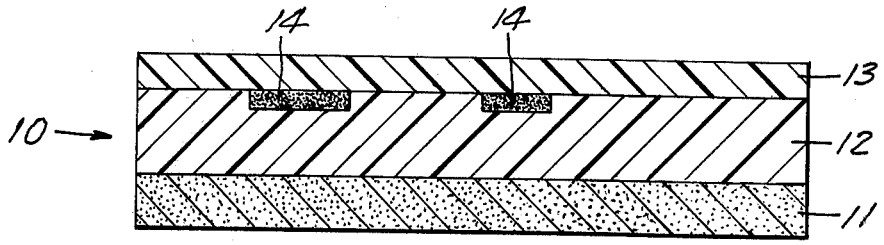
FIG. 2 is a cross-sectional view of the imprinted adhesive tape.

Upon removal of tape 10 from the assembly, as illustrated in FIG. 2, a permanently imprinted image 14 is obtained, the transferred dye having substantially penetrated through the backsize 13 to become absorbed or imbided in the flexible backing 12.

While FIG. 2 indicates that no transferred dye is imbided in or absorbed by backsize layer 13, a portion of the volatilized dye may in fact be so absorbed. All that is necessary is that a sufficient amount of the vaporized dye permeate the backsize to become absorbed in the backing and provide a clear indicia pattern therein which will be permanent and smudge proof.

Suitable volatilizable dyes are those which sublime at temperatures between about 50° C and about 250° C. There are many suitable dyes known in the art having this characteristic. They can be generally classified as solvent dyes, disperse dyes, or basic dyes, and have been found useful in transfer printing of textiles such as disclosed in "Dyes for Heat Transfer Printing" by J. Aihara et al, American Dyestuff Reporter, February, 1975 at pages 46–52. Examples of typical dyes useful in the invention include the following:

| | |
|---|---|
| YELLOW DYES | |
| Oil Yellow GR | C.I. 21240 |
| Intratherm Yellow P-345NT | C.I. Disperse Yellow 3 |
| Waxoline Yellow T | C.I. 47000 |
| Irgacet Yellow 3GCG | C.I. Solvent Yellow 48 |
| Cibacet Yellow GWL | C.I. 10338 |
| Cibacet Golden Yellow 3R | C.I. Disperse Yellow 56 |
| ORANGE DYES | |
| Brillant Fast Orange 2R | C.I. Solvent Orange 34 |
| Amasolve Orange EE | C.I. Disperse Orange 3 |
| Dispersol Fast Orange B | C.I. 26080 |
| Cibacet Brown 2RFL | C.I. Disperse Orange 30 |
| Eastman Polyester Orange GR-LSW | C.I. Disperse Orange 57 |
| RED DYES | |
| Polacet Scarlet GF2R | C.I. Disperse Red 54 |
| Amasolve Scarlet 2B | C.I. Disperse Red 7 |
| Cibacet Red 3BL | C.I. Disperse Red 82 |
| Genacron Pink RL | C.I. Disperse Red 86 |
| Sudan Red GGA | C.I. 21250 |
| VIOLET DYES | |
| Sudan Irisol | |
| Eastman Polyester Bordeaux 2B-LSW | C.I. Disperse Violet 44 |
| Amasolve Violet B | C.I. Disperse Violet 27 |
| Eastman Polyester Rubine R-LSW | C.I. Disperse Violet 42 |
| BLUE DYES | |
| Colliton Blue Green B | C.I. 62500 |
| Amasolve Blue BG | C.I. Disperse Blue |
| Cibacet Blue 2R | C.I. 61525 |
| Resoform Blue GL | C.I. 61525 |
| Eastman Fast Blue GLF | C.I. 60767 |
| Genacron Blue BRL | C.I. Disperse Blue 95 |
| GREEN DYES | |
| Brillant Fat Brown FR | C.I. Solvent Brown 9 |
| Latyl Brown MS | C.I. Disperse Brown 2 |
| WHITE DYES (Colorless but ultraviolet fluorescing) | |
| Intratherm White | P-341 |

Other examplary dyes are provided in American Dyestuff Reporter, July, 1974, at pages 22—28 and 64; and the Journal of the Society of Dyers and Colorists, December, 1971 at page 494.

The volatilizable dyes can be typically applied to a web such as a sheet, a foil or a woven or non-woven web of synthetic or natural fiber or metal. Preferably, the web consists of paper. The web should be of sufficient thickness to provide dimensional stability to the dye source material during the tape imaging process. Depending on the web material, thicknesses of from about 25 to about 250 microns have been found satisfactory.

The dye itself can typically be embedded or dissolved in the web or it can be absorbed or coated on the web surface. As hereinafter described, a sequential series of images can be obtained on the pressure-sensitive tape with a single dye source web. The dye concentation in the web can be from a minute amount up to saturation limits thereof. At extremely low concentrations, the number of images capable of being produced is correspondingly reduced.

High concentrations will produce a greater number of images but the web itself may become damaged or worn so as to make it unusable in the process and consequently economically costly. For the preferred paper web, a dye concentration of from about 0.1 to about 0.5 gram per square foot is optimal.

To provide smudge-proof, permanent indicia in the flexible backing of a pressure-sensitive tape, the backing must be a material in which the dye is soluble. Since the dyes listed above are relatively non-polar in character, suitable tape backings useful in the process of the invention are relatively non-polar, i.e. they do not contain a predominance of ionic groups therein. Exemplary materials include polymeric materials such as polypropylene, polyethylene, polyvinyl chloride, copoly (vinyl fluoride-vinyl acetate), copoly(vinyl fluoridevinylidene chloride,) polyamides and polyesters such as polyethylene terephthalate. Other suitable backings include fibrous materials such as paper, which are impregnated with non-polar polymeric materials. Such backings typically approximate 25 to 250 microns in thickness.

The backsize layer must be sufficiently permeable to the dye vapor to allow passage therethrough of a sufficient quantity of dye to provide an image in the backing. In some instances, the backsize material itself is nonpolar such that some of the dye vapor may be absorbed by the backsize itself. Such is not detrimental as long as sufficient dye vapor permeates the backsize layer to become absorbed in the backing.

The term "backsize" in this context includes coatings having release properties, abrasion resistance properties, solvent resistance properties, etc. Some typical backsize materials include urethanes as disclosed in U.S. Pat. No. 2,532,011, acrylate copolymers as described in U.S. Pat. No. 2,607,711 and fluorochemicals as described in U.S. Pat. No. 3,318,852.

The image or indicia may be formed in the backing of the pressure-sensitive adhesive tape by any means which can selectively direct the dye vapors from the dye source web in an imagewise fashion to the backing of the adhesive tape. Preferred is the utilization of a relief image on a suitably heat-conductive platen, typically formed from metal. The raised relief indicia can be contacted with the web of dye source material and the pressure-sensitive adhesive tape and heat applied to the entire platen whereupon the raised relief image areas which contact the dye source web will cause selective vaporization or sublimation and corresponding penetration of the tape backing in those image areas. Heat conductive platens or dies having relief images thereon for indicia formation may be prepared typically by stamping out metal plates or by utilization of a photoresist and etching such as is described for letter press preparation in U.S. Pat. No. 3,615,442.

Alternative means include stencils which typically are formed from a material which is impervious to the dye vapor, but which have perforations therein in an imagewise manner in accordance with the desired indicia such that the dye vapors pass through the openings in the stencil but are effectively precluded from penetrating through the solid portions of the stencil. Exemplary stencil materials include metal foil and silk screen stencils prepared using bichromated gelatin or polyvinyl alcohol film as the resist material. Stencils may be prepared by methods well known in the art, such as that described in the aforementioned Belgian Pat. No. 807,975. Similarly, a patent describing stencils which may be prepared using silver halide technology is described in U.S. Pat. No. 2,685,510.

The contact time necessary for production of a visible image by transfer of sublimed dye has been determined to be from about 0.1 second to about 10 seconds with from about 0.5 second to about 3 seconds being preferred. Decreasing contact times tend to reduce image density below optimum and contact times greater than 10 seconds are impractical.

Contact pressures should be sufficient to insure intimate contact between the components to thereby optimize diffusion of the dye vapors. A pressure on the composite of greater than about 0.5 pound per square inch is adequate for insuring contact.

Increasing presssure from about 0.5 to about 5.0 pounds per square inch may provide some increase in image density, but beyond that point minimal effect is noted.

Selection of specific dyes, contact times and contact temperatures must be based on the particular characteristics of the adhesive tape backing. For example, polypropylene has a lower melting temperature than polyester. Therefore, a dye suitable for polyester backings may have too great a sublimation temperature for use with polypropylene backings. Typically the specific dye should have a sublimation temperature lower than the melting temperature of the tape backing. Alternatively, reduced contact times can be utilized to minimize or eliminate elevated temperature effects.

The invention will now be more specifically illustrated by the use of the following non-limiting examples wherein all parts are by weight unless otherwise indicated.

EXAMPLE 1

A dye source material was prepared by first ball milling a mixture of 4.0 grams of Sudan Irisol dye (tradename for a solvent dye available from the GAF Corp.), 93.0 grams of Cellosolve and 7.0 grams of Ethyl Cellulose N-22 (tradename for an ethyl cellulose resin available from the Hercules Chemical Corp.). This mixture was coated onto bond paper utilizing a number 24 Meyer bar and allowed to dry overnight at room temperature.

A stencil was prepared utilizing a stainless steel mesh screen and silver halide/dichromate photoemulsion technology in accordance with U.S. Pat. No. 2,685,510, incorporated herein by reference.

A section of No. 355 Scotch Brand Box Sealing Tape, which is a tradename for a polyester-backed, pressure-sensitive adhesive tape having a polyvinyl octadecyl carbamate low adhesion backsize thereon, as disclosed in U.S. Pat. No. 2,532,011, and is available from the Minnesota Mining and Manufacturing Company was adhered to a piece of cardboard. The stencil was placed against the backsized surface of the tape and a section of the dye source web was placed over the stencil. This composite assembly was then placed in a Double A Transfer Press, tradename for a 250 cm × 250 cm laboratory press having an upper heated platen and a lower resilient non-heated platen available from Phipps-Fair Limited, with the heated platen being placed against the dye source web.

With the heated platen at 210° C, the press was pressurized at 3.0 pounds per square inch (0.2 gram per square centimeter) for 10 seconds following which the composite assembly was removed from the press. The tape had indicia imprinted thereon in accordance with the stencil pattern which was not removed by mild abrasion of the tape surface. Excessive abrasion down into the polyester backing itself was the only manner in which the image was capable of being removed.

Utilizing an RD-100 Macbeth Quantalog Densitometer with a No. 106 wrattan visual filter, the optical reflection density of the indicia on the tape was determined to be 0.82 and that of the background, i.e. the tape itself was determined to be 0.1. Utilizing the same placement of the dye source web and stencil and sequentially repeating the printing process on fresh sections of the tape, indicia having optical reflection densities shown in the table below were obtained.

Table I

| Printing Step No. | Density | Printing Step No. | Density | Printing Step No. | Density |
|---|---|---|---|---|---|
| 1 | 0.82 | 8 | 0.90 | 15 | 0.70 |
| 2 | 0.93 | 9 | 0.88 | 16 | 0.65 |
| 3 | 0.90 | 10 | 0/88 | 17 | 0.62 |
| 4 | 0.93 | 11 | 0.82 | 18 | 0.62 |
| 5 | 0.97 | 12 | 0.80 | 19 | 0.58 |
| 6 | 0.96 | 13 | 0.77 | 20 | 0.57 |
| 7 | 0.90 | 14 | 0.75 | | |

From Table I, it is observed that after 20 sequential indicia have been imprinted on the polyester-backed tape sections from a single dye source location, the optical density of the indicia was only reduced from 0.82 to 0.57. Since readily visible images may be obtained when the optical density of the image is only about 0.1 greater than the background density, it is apparent that more than 20 acceptable impressions can be obtained from a single dye source material.

EXAMPLE 2

When the Sudan Irisol dye of Example 1 is replaced by Amasolve Scarlet 2B, tradename for an azo disperse dye, available from the American Color and Chemical Co., Amasolve Blue FS, tradename for an anthraquinone disperse dye available from American Color and Chemical Co. or Oil Blue A, tradename for an anthraquinone solvent dye available from the DuPont Co., results similar to those of Example 1 are obtained.

EXAMPLE 3

A metal die was prepared by bending a No. 16 AWG copper wire (approximately 1.3 millimeters in diameter) into a planar pattern. This die was placed on the dye source web and tape of Example 1. Upon placement of the composite assembly in the press of Example 1 for 10 seconds at 210° C, the tape had a colored pattern thereon corresponding to the die pattern which was imprinted into the polyester backing and could not be removed by scraping the tape surface.

EXAMPLE 4

Example 3 was repeated using the 75 micron thick polypropylene as the tape backing and the Oil Blue A dye source of Example 2. At a press operation temperature of 150° C for 2.0 seconds, results corresponding to Example 3 were obtained.

When 75 micron thick polyvinyl chloride was utilized as the tape backing and the press operated at 100° C for 10 seconds, similar results were obtained.

What is claimed is:

1. A method for imprinting permanent, smudge-proof indicia on backsized pressure-sensitive tape comprising a flexible backing having a pressure-sensitive adhesive on one surface thereof and a dye-permeable backsize coating on the other surface thereof, said process comprising the steps of:

a. placing a dye source web, comprising a dimensionally stable substrate containing a heat-sublimable dye on said backsize coating of said pressure-sensitive tape; and b. placing a heat conductive relief-imaged platen on the surface of said dye source web such that the relief image contacts said dye source web; and c. pressing the pressure-sensitive adhesive tape, the dye source web and the relief-imaged platen together such that intimate contact is maintained therebetween; and d. heating the heat-conductive platen to the dye sublimation temperature; and e. dyeing the flexible backing of said pressure-sensitive tape to thereby provide a visible image therewithin by maintaining said contact at said temperature for a time sufficient to cause dye to permeate through said backsize coating and into said flexible backing.

2. The method of claim 1 wherein said heat-conductive platen is metal.

3. A method for imprinting permanent, smudge-proof indicia on backsized pressure-sensitive tape comprising a flexible backing having a pressure-sensitive adhesive on one surface thereof and a dye-permeable backsize coating on the other surface thereof, said process comprising the steps of:

a. placing a stencil, comprising a substrate having image areas thereon permeable to dye vapor and background areas impermeable to dye vapor, on said backsize coating of said tape; and b. placing a dye source web, comprising a dimensionally stable substrate containing a heat-sublimable dye on said stencil; and c. pressing the pressure-sensitive adhesive tape, the dye source web and the stencil together such that intimate contact is maintained therebetween; and d. heating the dye source web to the dye sublimation temperature; and e. the flexible backing of said pressure-sensitive tape to thereby provide a visible image therewithin by maintaining said contact at said temperature for a time sufficient to cause dye to permeate through said backsize coating and into said flexible backing.

* * * * *

UNITED STATES PATENT AND TRADEMARK OFFICE

CERTIFICATE OF CORRECTION

PATENT NO. : 4,063,878

DATED : December 20, 1977

INVENTOR(S) : Bruce W. Weeks

It is certified that error appears in the above-identified patent and that said Letters Patent are hereby corrected as shown below:

Column 3, line 37, after "GREEN DYES" should read
-- Sudan Green 4B C.I. Solvent Green 3
C.I. 61565
BROWN DYES --;

Column 8, line 17, "e. the" should read -- e. dyeing the --.

Signed and Sealed this

Eleventh Day of April 1978

[SEAL]

Attest:

RUTH C. MASON
Attesting Officer

LUTRELLE F. PARKER
Acting Commissioner of Patents and Trademarks